US005564946A

United States Patent [19]

Kodama

[11] Patent Number: 5,564,946

[45] Date of Patent: Oct. 15, 1996

[54] WATERPROOF CONNECTOR

[75] Inventor: Shinji Kodama, Shizuoka-ken, Japan

[73] Assignee: Yazaki Corporation, Tokyo, Japan

[21] Appl. No.: 521,464

[22] Filed: Aug. 30, 1995

Related U.S. Application Data

[63] Continuation of Ser. No. 229,754, Apr. 19, 1994, abandoned.

[30] Foreign Application Priority Data

Apr. 19, 1993 [JP] Japan ..... 5-091347

[51] Int. Cl.[6] ..... H01R 13/52

[52] U.S. Cl. ..... 439/587; 439/275

[58] Field of Search ..... 439/587, 589, 439/274, 275, 865–868

[56] References Cited

U.S. PATENT DOCUMENTS

| | | | |
|---|---|---|---|
| 3,573,720 | 4/1971 | Reynolds | 439/733 |
| 3,787,800 | 1/1974 | Barker et al. | 439/866 |
| 3,844,923 | 10/1974 | Sandrock | 439/865 |
| 4,973,266 | 11/1990 | Bullard | 439/859 |
| 5,351,973 | 10/1994 | Taniuchi et al. | 439/587 |

*Primary Examiner*—Neil Abrams

*Attorney, Agent, or Firm*—Wigman, Cohen, Leitner & Myers, P.C.

[57] ABSTRACT

A waterproof connector capable of maintaining the sealing capability even if an electric wire accommodated therein is subjected to external force causing the wire to be bent. The waterproof connector includes a connector housing having an aperture extending therethrough, a terminal having a crimp-part for crimping an electric wire and a rubber plug having a through hole to provide a tight seal between the wire and the connector housing, The rubber plug has a cylindrical part to be crimped by the crimp-part of the terminal. Radially inwardly of the part and on an internal surface of the through hole, a projection is formed to seal between the external surface of the wire and the internal surface of the through hole.

6 Claims, 3 Drawing Sheets

WATERPROOF CONNECTOR

This is a continuation of application Ser. No. 08/229,754, filed on Apr. 19, 1994, now abandoned.

BACKGROUND OF THE INVENTION

This invention relates to a waterproof connector for use in an electric wiring on motor vehicles or the like.

In a waterproof connector, a connector housing is provided with an aperture formed therein from a front end of the connector to a rear end thereof and into which a crimp-style terminal is inserted. The terminal has an electric wire crimped at a rear end thereof. In order to attain a waterproof function of the connector, a cylindrical rubber plug is arranged in the aperture. The rubber plug has a through hole into which the electric wire is sealingly fitted. In the conventional connector, the rubber plug includes two external projections formed on an external surface of the plug and two internal projections formed on an internal surface of the through hole. On each surface, these projections are arranged axially apart from each other to sealingly engage with an internal surface of the aperture and an external surface of the electric wire, respectively.

However, in the above-mentioned connector, when the assembled wire is pulled obliquely toward a direction of the insertion into the connector by external force, compression between the plug and the internal projections is lowered partially, whereby a clearance will be produced between the internal projections and the wire to decrease the sealing capability.

SUMMARY OF THE INVENTION

It is an object of the present invention to provide a waterproof connector capable of maintaining the sealing capability even if an electric wire accommodated therein is subjected to external force causing the wire to be bended.

The objects of the invention described above can be accomplished by a waterproof connector for an electric wire, comprising:

a connector housing for receiving the electric wire, the connector housing having an aperture extending therethrough into which the electric wire is inserted;

a terminal having a crimp-part at a rear end thereof to crimp the electric wire, the terminal being inserted into the aperture;

a rubber plug accommodated in the aperture to provide a tight seal between an external surface of the wire and an internal surface of the aperture, the rubber plug having a through hole extending axially therethrough, into which the electric wire is fitted, the rubber plug having a part to be crimped by the crimp-part of the terminal; and means for sealing between the external surface of the wire and an internal surface of the through hole of the rubber plug, the sealing means being provided in the part of the rubber plug.

In the preferred aspect of the present invention, the sealing means comprise a circumferential projection formed on the internal surface of the through hole of the rubber plug. In an assembled state where the part of the rubber plug is tightened by the crimp-part of the terminal, the circumferential projection in the part is pressed against the external surface of the wire. Therefore, even if the electric wire is pulled obliquely, the circumferential projection can be maintained so as to be firmly pressed against the external surface of the wire, whereby the sealing ability can be maintained.

In one form of the projection, it may comprise a projection which projects radially inwardly from the internal surface of the through hole in a free state where any external force is not exerted on the rubber plug.

In another form of the projection, it may comprise a part of the rubber plug deformed by a circumferential protrusion formed on an internal surface of the crimp-part.

These and other objects and features of the present invention will become more fully apparent from the following description and appended claims taken in conjunction with the accompanying drawings.

DESCRIPTION OF THE PREFERRED EMBODIMENT

Figure 1:
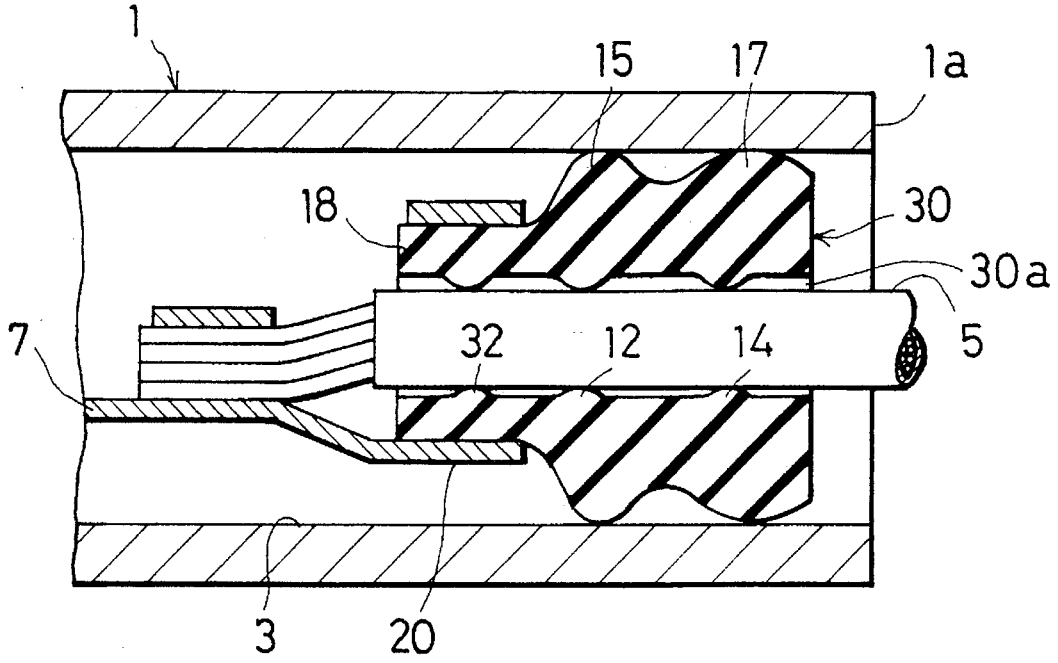
FIG. 1 is a longitudinal sectional view showing a waterproof connector according to a first embodiment of the present invention.

Referring initially to FIG. 1, reference numeral 1 denotes a connector housing, 3 an aperture, 5 an electric wire, 7 a crimp-style terminal, and 30 a rubber plug. In the connector housing 1, the aperture 3 extends axially therethrough, from a front end (not shown) of the connector 1 to a rear end 1*a*. Inserted into the aperture 3 is the crimp-style terminal 7 which carries the electric wire 5 to be tightened by a crimp-part 20 formed at a rear end of the terminal 7.

The cylindrical rubber plug 30 accommodated in the connector housing 1 has a through hole 30*a* extending axially therethrough. The electric wire 5 is sealingly fitted in the through hole 30*a*. As shown in FIG. 1, the rubber plug 30 includes two external projections 15 and 17 which are circumferentially formed on an external surface thereof in the axial direction of the plug 30, the projection 15 is apart from the projection 17. In an assembled state where the electric wire 5 with the terminal 7 is inserted into the connector housing 1, the external projections 15 and 17 elastically bear on an internal surface of the aperture 3 to thereby provide tight seals between the connector housing 1 and the rubber plug 30. Similarly, circumferential projections 12 and 14 are formed on an internal surface of the through hole 30*a* to bear on the external surface of the wire 5 elastically in the assemble state. These internal projections 12 and 14 are axially spaced from each other.

The rubber plug 30 has a cylindrical part 18 to be firmly tightened by the crimp-style terminal 7. The diameter of the portion 18 is reduced in comparison with the other part provided with the projections 12, 14, 15 and 17.

According to this embodiment, in addition to the internal projections 12 and 14, the plug 30 has an additional internal projection 32 arranged radially inwardly of the cylindrical part 18. The projection 32 is formed so as to project inside the internal surface of the through hole 30*a* in a free state when no external force is applied on the plug 30. Consequently, when the cylindrical part 18 is tightened by the terminal 7 through the intermediary of the crimp-part 20, the projection 32 is strongly pressed against the external surface of the electric wire 5. In such condition, since the position of the projection 32 is included within a width of the crimp-part 20 in an axial direction of the plug 30, the projection 32 is restricted by the cylindrical part 20 certainly.

Figure 2:
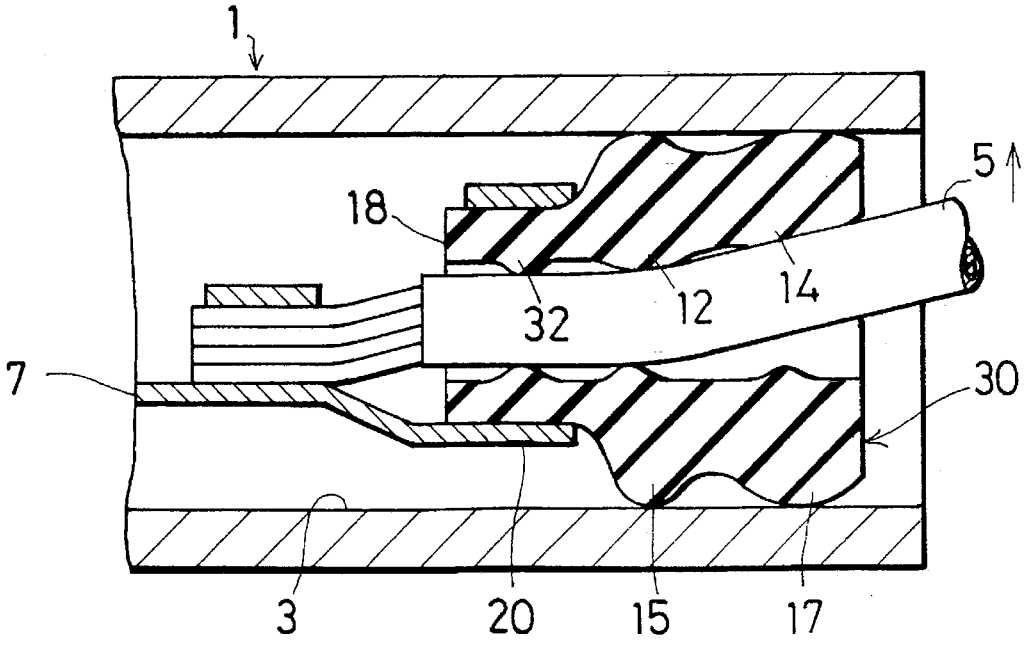
FIG. 2 is a sectional view showing an operation of the connector of FIG. 1.

According to this arrangement, even if the electric wire 5 is pulled obliquely as shown in FIG. 2, the projection 32 of the invention can be maintained so as to be firmly pressed against the external surface of the wire 5. Therefore, it can be avoided that a clearance is produced between the wire 5 and the rubber plug 30, whereby the sealing capability can be maintained. Furthermore, since the projection 32 is formed in process of molding the rubber plug 30, the projection 32 can be engaged with the external surface of the wire 5 certainly, although the crimp-part 20 is crimped with weak force.

Note that, due to the above-mentioned arrangement, a conventional waterproof connector can be easily converted into the connector of this embodiment, if only a conventional rubber plug is replaced with the aforementioned rubber plug 30.

Figure 3:
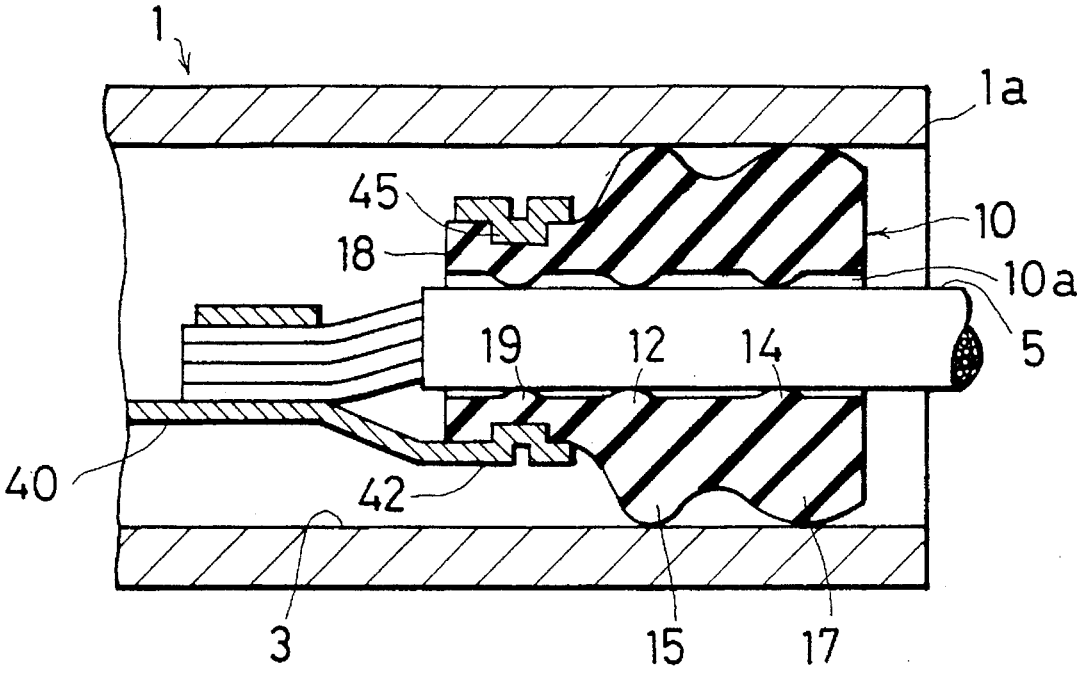
FIG. 3 is a longitudinal sectional view showing a waterproof connector according to a second embodiment of the present invention.
Figure 4:
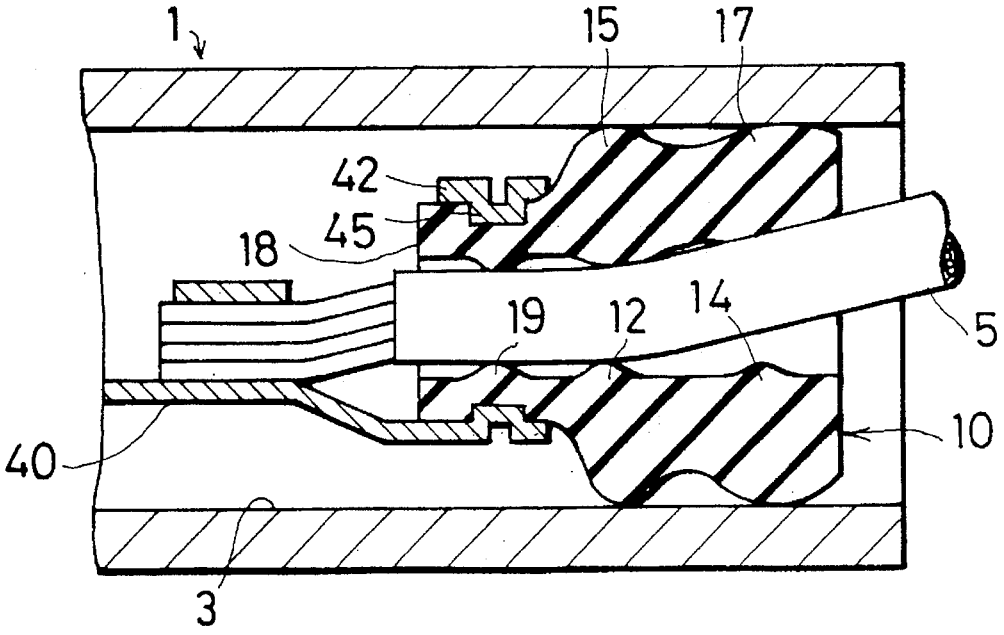
FIG. 4 is a sectional view showing an operation of the connector of FIG. 3.

FIGS. 3 and 4 show another waterproof connector in accordance with a second embodiment of the invention. Note that, through the figures, the elements similar to those of FIGS. 1 and 2 are indicated by the same reference numerals.

According to this embodiment, the above-mentioned conventional rubber plug 10, which include the projections 12, 14, 15 and 17, can be employed. A crimp-style terminal 40 is characteristic of this embodiment. The terminal 40 has a crimp-part 42 at its rear end, which is different from the conventional crimp-part.

Figure 5:
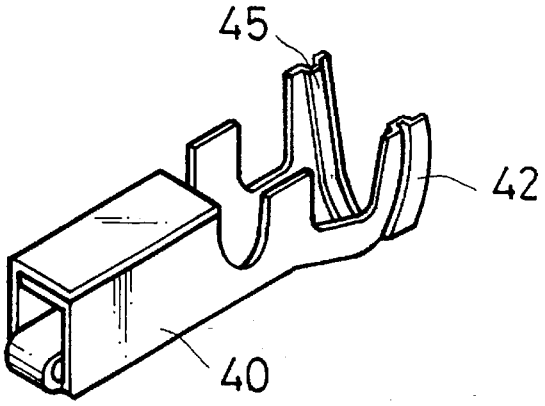
FIG. 5 is a perspective view showing a crimp-style terminal according to a third embodiment of the present invention.
Figure 6:
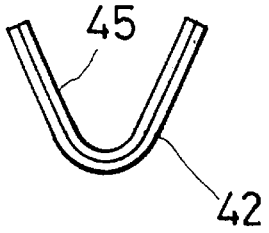
FIG. 6 is a rear view of the terminal of FIG. 5.
Figure 7:
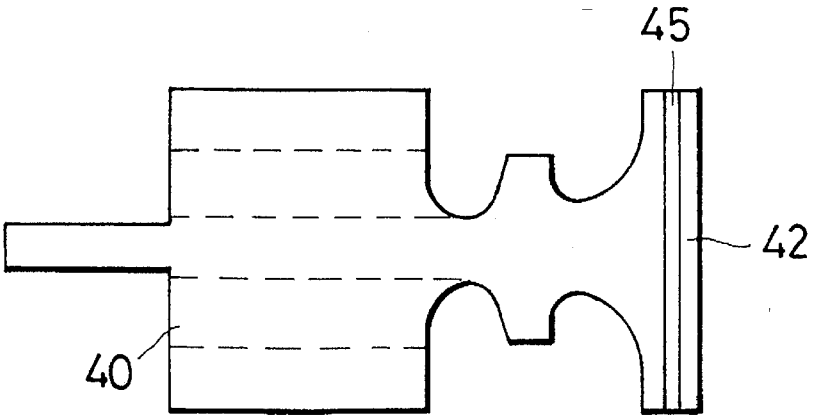
FIG. 7 is an unfolded view of the terminal of FIG. 5.

As shown in FIGS. 5 and 6, the crimp-part 42 of the terminal 40 is provided with a protrusion 45 which is formed on the internal surface of the crimp-part 42 circumferentially. Again, in the axial direction of the terminal 40, the protrusion 45 is positioned in the middle of the internal surface thereof. The protrusion 45 can be obtained by press-forming a sheet of material shown in FIG. 7. When assembling the terminal 40 to the rubber plug 10, the crimp-part 42 is crimped so as to press the cylindrical part 18 against the external surface of the electric wire 5. Consequently, due to urging by the protrusion 45, the cylindrical part 18 of the rubber plug 10 is partially deformed radially inwardly, so that the circumferential projection 19 can be produced on an internal surface of a through hole 10*a* of the plug 10, firmly engaging with the external surface of the wire 5.

In such waterproof connector, even if the electric wire 5 is pulled obliquely as shown in FIG. 4, the projection 19 formed in the vicinity of the crimp-part 42 can be maintained so as to be firmly pressed against the external surface of the wire 5, whereby the sealing capability can be maintained. Note that, due to the abovementioned arrangement, the conventional waterproof connector can be easily converted into the connector 1 of the embodiment, using the conventional rubber plug 10, if only the conventional terminal is exchanged for the terminal 40 of the embodiment.

Finally, it will be understood by those skilled in the art that the forgoing description of the preferred embodiments of the disclosed structure, and that various changes and modifications may be made to the present invention without departing from the spirit and scope thereof.

What is claimed is:

1. A waterproof connector for an electric wire, comprising:

a connector housing for receiving said electric wire, said connector housing having an aperture therethrough into which said electric wire is inserted;

a terminal having a crimp-part at a rear end thereof to crimp said electric wire, said terminal being inserted into said aperture and said crimp-part having a length extending in an axial direction of said wire;

a rubber plug accommodated in said aperture to provide a tight seal between a first external surface of said wire and an internal surface of said connector housing aperture, said robber plug having a through hole extending axially therethrough, into which through hole said electric wire is fitted in generally coaxial alignment therewith, said rubber plug having a part to be crimped by said crimp-part of said terminal and extending into sealing contact with a second external surface of the wire; and said part of said rubber plug including a circumferential projection formed during molding of said rubber plug and extending inwardly from an internal surface of said through hole of said plug for forming a sealing engagement with the second external surface of the wire radially inwardly of said crimp-part, whereby said sealing engagement is maintained even when said electric wire is offset from the generally coaxial alignment with said through hole.

2. A waterproof connector for an electric wire, as claimed in claim 1, wherein said terminal includes a circumferential protrusion extending inwardly from said internal surface of said crimp-part and wherein said part of said rubber plug is deformed by said circumferential protrusion.

3. A waterproof connector for an electric wire, as claimed in claim 1 or 4, wherein said part of said rubber plug immediately adjacent said crimp part is shaped to be cylindrical with a reduced diameter in comparison with that of the other parts of said rubber plug.

4. A waterproof connector for an electric wire, as claimed in claim 3, wherein, besides said circumferential projection, said rubber plug has at least one external projection on its external surface to contact with said internal surface of said aperture and at least one internal projection on said internal surface of said through hole to contact with said external surface of said electric wire.

5. A waterproof connector for an electric wire, as claimed in claim 2, wherein said circumferential protrusion of said terminal is substantially coplanar with said circumferential projection extending inwardly from said through hole.

6. A waterproof connector for an electric wire, as claimed in claim 1, said plug including a second circumferential protrusion extending inwardly from said internal surface of said through hole axially offset from said crimp-part, to sealingly engage with said first external surface of said wire, said second circumferential protrusion remaining substantially sealingly engaged with said first external surface even when said electric wire is offset from the generally coaxial alignment with said through hole at said connector housing aperture.

* * * * *